United States Patent [19]

Kläeger

[11] Patent Number: 4,519,527

[45] Date of Patent: May 28, 1985

[54] HAND POWERED LIQUID ATOMIZER

[76] Inventor: Karlheinz Kläeger, Portnerstr. 84, 8902 Neusaess, Fed. Rep. of Germany

[21] Appl. No.: 515,317

[22] Filed: Jul. 19, 1983

[30] Foreign Application Priority Data

Jul. 21, 1982 [DE] Fed. Rep. of Germany ..... 3227150
Dec. 9, 1982 [DE] Fed. Rep. of Germany ..... 3245493

[51] Int. Cl.[3] ..... B05B 9/043

[52] U.S. Cl. ..... 222/383; 222/482; 239/333

[58] Field of Search ..... 22/321, 372, 375, 380, 22/382, 383, 385, 207, 464, 478, 481, 482; 239/333

[56] References Cited

U.S. PATENT DOCUMENTS

| | | | |
|---|---|---|---|
| 3,685,739 | 8/1972 | Vanier | 222/383 X |
| 3,780,951 | 12/1973 | Powers | 239/333 |
| 4,168,788 | 9/1979 | Quinn | 222/383 |
| 4,310,107 | 1/1982 | Wesner | 222/380 X |
| 4,365,751 | 12/1982 | Saito et al. | 222/380 X |

*Primary Examiner*—Joseph J. Rolla
*Assistant Examiner*—Kevin P. Shaver
*Attorney, Agent, or Firm*—Flynn, Thiel, Boutell & Tanis

[57] ABSTRACT

A hand powered liquid atomizer has a pistol-like housing with a union nut supported at the free, lower end of a handle part thereof so that the nut may be screwed onto a liquid vessel. The nut is supported on the housing by a holding part. The holding part is made of an elastic material and is stepped. It has a cylindrical part with a large diameter joined by a ring-like shoulder with a cylindrical headpiece having a middle hole and a diameter smaller than the large diameter. A pocket in the handle part of the housing is stepped in a way matching the step of the holding part, and has a first part which receives the cylindrical part of the holding part and which is joined by an annular step with a second part having a smaller diameter which receives the headpiece. The step has therethrough at least one air inlet hole which communicates with the outside air, and the shoulder has therethrough an air inlet hole which communicates with the inside of the vessel. In the space between the step and the shoulder there is an elastic annular diaphragm which is molded on and integral with the holding part in a manner so that the diaphragm is seated elastically on the annular step and covers the air inlet hole.

5 Claims, 2 Drawing Figures

PUMP
2A
D2
D1

HAND POWERED LIQUID ATOMIZER

FIELD OF THE INVENTION

The present invention relates to a hand powered liquid atomizer and, in particular, to an atomizer having a piston-like housing, a union nut supported at a lower free end of a handle part of the housing and designed to be screwed onto the neck of a liquid vessel, a synthetic resin holding part that is generally cylindrical and has a flange to support the nut, the housing having a generally cylindrical pocket in which the holding part is sealingly seated, the holding part further having a middle hole joined up with a length of flexible pipe which extends into the vessel, a diaphragm forming a check valve for letting air into the vessel, the diaphragm being made of an elastic material, a pump positioned within the housing, and a pump lever for operating the pump.

BACKGROUND OF THE INVENTION

In the case of one such hand powered liquid atomizer with a pistol-like housing (see German Offenlegungsschrift No. 2 101 445), the flange is next to a part of the holding part which is somewhat conical in form and is force fitted into a matching, somewhat conical pocket in the handle part. The flange has an air inlet hole through it which communicates with the outside air. Between the lower end face of the flange and the top edge of the vessel neck there is an elastic ring-diaphragm whose ring-like part is gripped between the flange and the top edge of the vessel so as to form a seal. Next to this ring-like part there is a frusto-conical part having a hole through its middle. At the edge of this middle hole this frusto-conical part rests against a middle tube extending down from the flange, a flexible pipe being plugged into the tube and extending into the vessel. Normally the frusto-conical part of the ring-diaphragm rests against the tube so that when the atomizer is being shipped or is being used, liquid will be kept from running out of the vessel. On operating the pump of the atomizer, a vacuum will be produced in the flexible pipe and liquid will be aspirated out of the vessel so that, in turn, a vacuum will be produced in the vessel. This vacuum is then to be overcome by lifting the edge of the frusto-conical part of the ring-diaphragm away from the tube so that air may make its way into the vessel.

Quite in addition to the fact that the ring-diaphragm is a further, separate part of the atomizer which has to be manufactured and put in place separately and is likely to come off a liquid atomizer that is loose and not screwed on a vessel, for example while being shipped to the filling plant, it is very hard to ensure that the ring-diaphragm is made with such a quality of material and such a thickness that on the one hand the diaphragm will be seated air-tightly on the tube all the time that no air is to be let in, while, on the other hand, it is lifted clear of the tube when there is the least degree of vacuum in the vessel. Such lifting of the diaphragm is in fact only possible when the inner diameter of the frusto-conical part is elastically widened. The letting of air into the vessel to overcome a vacuum therein is more specially desired if there is a chance of the liquid diffusing out through the wall of the vessel. Most such vessels are made of synthetic resin. A vacuum will be produced by such diffusion and if the wall is thin, it will be partly collapsed and will take on a dented form if no air is let into it to overcome the least degree of vacuum.

A purpose of the invention is that of designing a hand powered liquid atomizer of the sort noted hereinbefore in such a way that the number of parts near and at the union nut is cut down, so that the manufacture and assembly of the parts will be cheaper and parts will be kept from coming off and being lost, while at the same time the equalization of pressure between the inside of the vessel and the air outside is made more perfect.

SUMMARY OF THE INVENTION

This is made possible according to the invention by the holding part being stepped and made of an elastic material, and having a cylindrical part with a large diameter which is joined by way of a ring-like shoulder with a cylindrical headpiece which has a diameter smaller than the large diameter, the headpiece having the middle hole extending therethrough and being above the large diameter part. The pocket in the housing is made with a matching step and has a first part to take up the first cylindrical part of the holding part, the first part of the pocket being connected by the step with a second part of the pocket having a smaller diameter to take up the headpiece. The step of the pocket has an air inlet hole running through it to the outside, and the ring-like shoulder of the holding part, which is spaced from the shoulder of the pocket, has an air hole running through it to the inside of the vessel. The elastic diaphragm is located in the space between the shoulder of the holding part and the step of the pocket, the diaphragm being molded on and in one piece with the shoulder of the holding part or of the headpiece and resting elastically against the step of the pocket so as to cover the air inlet hole therein.

By using this design of the atomizer, the number of parts is cut down and the manufacture and assembly thereof made cheaper. In the invention, the holding part has a number of important functions. It keeps the union nut joined to the handle part of the housing, while at the same time forming a check valve for letting air into the vessel and (since it is made of elastic material) forming a seal or gland between the union nut and the top edge of the vessel neck. A further point is that the holding part may have a valve ball space within it as part of the middle hole therein. Because the diaphragm is molded in one piece with and on the holding part, it does not have to be made and assembled separately and there is furthermore no chance of its coming off and being lost when the atomizer is being shipped and handled without the vessel. However, a further and highly important point is the better inlet of air into the vessel when there is the least difference in air pressure. The diaphragm, resting like a flange on the flat annular face of the step of the pocket, may in fact be bent or deformed axially quite readily so that, when there is a vacuum in the vessel, it is lifted clear of the step by the pressure of the outside air, and the air then makes its way into the vessel. On the other hand, if the vessel is pushed over, is transported on its side or upside down, or is turned over onto its side when spraying, the readily deforming diaphragm will be seated fully and tightly against the step of the pocket, because in such cases the diaphragm will be forced by the head of the liquid in the vessel against the step of the pocket, this backing up of the diaphragm's own elastic force with the tendency of keeping it against the step.

In keeping with a more specially useful form of the atomizer of the invention, the elastic diaphragm is in the form of a ring-like diaphragm placed coaxially in relation to the holding part. This makes it possible for the holding part to be inserted into the cylindrical pocket in the handle with any desired angular orientation. It is useful if the ring-diaphragm is made up of a flange-like part resting against the step, a sleeve-like part concentric to the headpiece and joined to the ring-like shoulder, and a part that is curved in cross section and connects the other two diaphragm parts together. This design, on one hand, ensures that the ring-diaphragm is elastically urged to a position tightly and fully seated on the step while on the other hand it will be readily lifted clear of the step when there is a vacuum in the vessel. A further point is that its shape makes manufacture of the holding part simpler.

In this respect it is best if the sleeve-like part is located concentrically within and the flange-like part is located concentrically outside an imaginary cylinder. This form of the invention makes the design of the mold for the holding part even simpler.

BRIEF DESCRIPTION OF THE DRAWINGS

A detailed account of the invention will now be given using working examples to be seen in the figures.

DETAILED DESCRIPTION

Figures 1, 2:
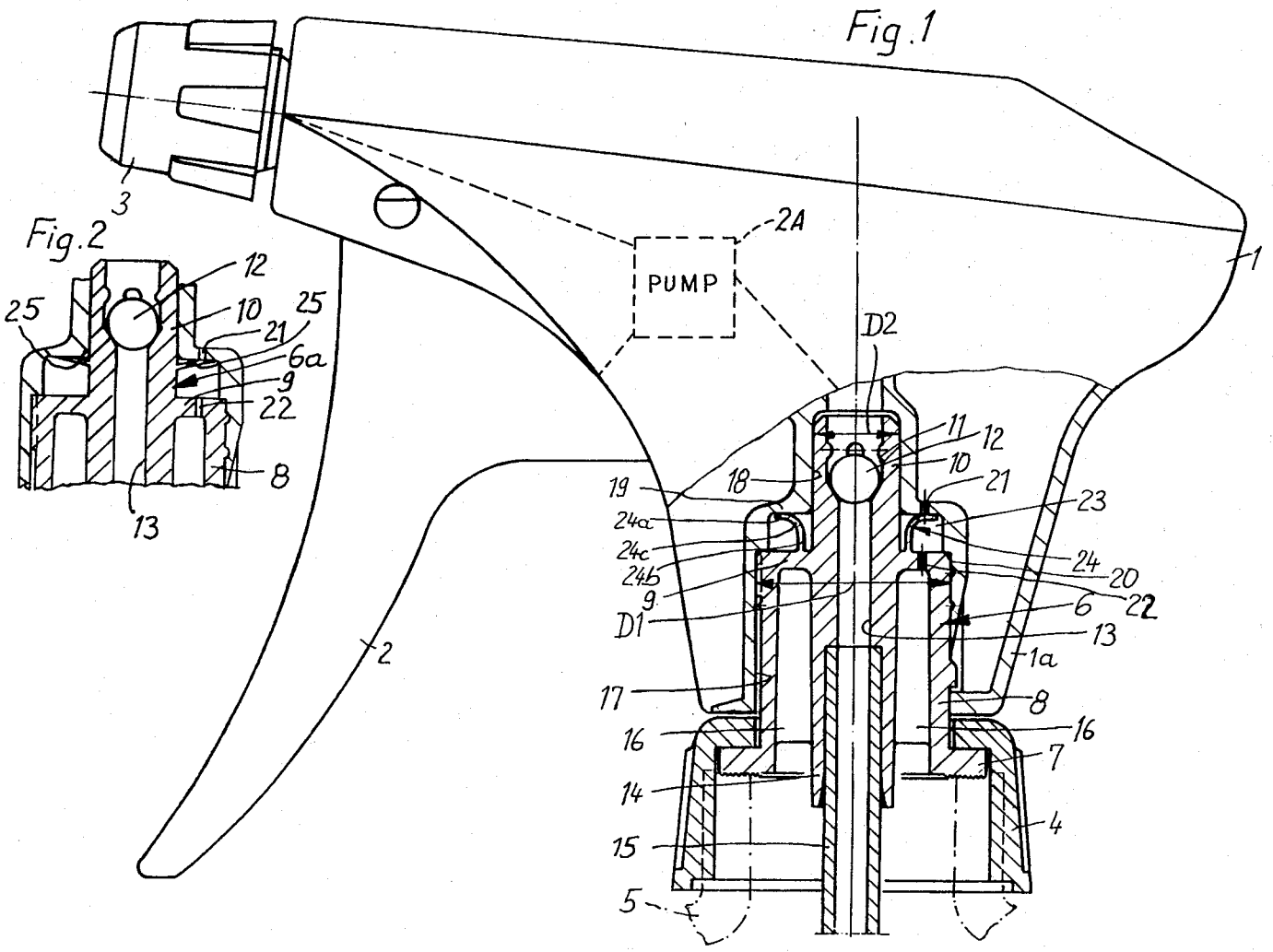
FIG. 1 is a side view, partly in section, of an atomizer embodying the invention.
FIG. 2 is a section through part of a second embodiment of the atomizer.

The atomizer for liquids has a pistol-like housing 1 with a pump lever 2 on it. Inside the housing there is a conventional pump mechanism 2A which is not to be seen in detail and may be operated by the pump lever 2. At the front end of the pistol-like housing there is an adjustable spraying and atomizing nozzle 3.

At the lower end of a handle part 1*a* there is a union nut 4, which may be screwed onto a vessel neck 5 marked in chain lines. The union nut 4 is joined to the housing by a holding part 6 that is furthermore used as a seal between the nut and the neck 5. This holding part 6 has a flange 7 and a cylindrical first part 8 joined thereto. This first cylindrical part 8 has a large diameter D1 and is joined up by way of a ring-like shoulder 9 with a cylindrical headpiece 10, whose diameter D2 is much smaller than the large diameter D1. In the headpiece 10 there is a space 11 for the ball 12 of a check valve of the pump. The headpiece 10 has extending therethrough the middle hole 13 which opens into a tube 14, into which an end of a flexible aspiration pipe 15 is plugged, the pipe 15 extending into the vessel. Between the cylindrical part 8 and the tube 14 it is furthermore possible to have stiffening webs 16.

To receive the holding part 6 in the handle part 1*a*, the handle part 1*a* has a stepped cylindrical pocket, including a first part 17 with a large diameter for receiving the cylindrical part 8 of the holding part 6. The first part 17 is joined by an annular stage or step 19 with a second part 18 of the pocket which has a smaller diameter than the part 17 and receives the headpiece 10. The ring-like shoulder 9 is axially spaced from the step 19 and, to make certain of this, a further small ring-like step 20 may be provided to position the holding part 6. The ring-like step 19 has an air inlet hole 21 therethrough communicating with the outside air. Further, there is an air inlet hole 22 through the ring-like shoulder 9 which communicates with the inside of the vessel. In the space 23 between the ring-like shoulder 9 and the ring-like step 19 there is an annular diaphragm 24 that is molded on and integral with the ring-like shoulder 9. The diaphragm, which is generally numbered 24, is seated against the ring-like step 19 so as to cover the air inlet hole 21.

The elastic diaphragm 24 is made up of a flange-like part 24*a* resting against the ring-like step 19, a sleeve-like part 24*b* that concentrically encircles the headpiece 10 and is joined to the ring-like shoulder 9, and a part 24*c* which joins the two parts 24*a* and 24*b* together and has a curved or arcuate cross section. The sleeve-like part 24*b* is, in this respect, located concentrically within and the flange-like part 24*a* is located concentrically outside an imaginary cylinder.

Normally the flange-like part 24*a* of the diaphragm 24 will be seated elastically against the ring-like step 19, thereby sealing the air inlet hole 21. If the vessel is tilted, the liquid inside the vessel will be able to get through the air inlet hole 22 into the space 23 and act on the inside of the flange-like part 24*a*, so that the force with which the flange-like part 24*a* is pressed against the ring-like step 19, and for this reason the sealing force, is increased.

If there is a vacuum in the inside of the vessel, for example caused by taking liquid from the vessel by atomizing it, or by diffusion of the liquid through the wall of the vessel, the higher pressure of the outside air will be responsible for pushing the flange-like part 24*a* at the air inlet hole 21 downward so that air may make its way into the space 23 and from the space 23 through the air inlet hole 22 into the vessel.

The working example of the invention in FIG. 2 is different from the example discussed above only in that, in FIG. 2, the annular diaphragm 25 is provided on the headpiece 10. In this respect, it is spaced axially from the ring-like shoulder 9 so that it may readily give way elastically in an axial direction. To make certain that the diaphragm 25 is tightly seated on the step 19, the diaphragm 25 is frusto-conical in shape, as evident from FIG. 2. Because the other parts of the system are identical in function as in the working example of FIG. 1, the same observations made in connection with FIG. 1 are also true for the example of FIG. 2.

If desired, a diaphragm might be used, in place of the diaphragm 25, which extends only partly around the headpiece 10 and the annular shoulder 9 and is aligned with the hole 21. In this case, however, the holding part 6 or 6*a* would have to be oriented in a given angular position before inserting it into the pocket 17 and 18, and would have to be secured in this angular position, for example by a cooperating key and groove.

The embodiments of the invention in which an exclusive property or privilege is claimed are defined as follows:

1. In a hand powered liquid atomizer which includes a pistol-like housing; a union nut supported adjacent a lower end of a handle part of said housing, said nut being designed to be screwed onto a neck of a liquid vessel; a synthetic resin holding part which is generally cylindrical and has a flange at its lower end which supports said nut, said handle part of said housing having a generally cylindrical pocket in which said holding part is sealingly seated, said holding part further having therethrough a middle hole joined up with a length of flexible pipe adapted to extend into the vessel; a diaphragm which forms a check valve for letting air into the vessel, is provided on said holding part, and is made of an elastic material; a pump positioned within said housing; and a pump lever for operating said pump; the improvement comprising wherein said holding part is stepped and made of an elastic material, and has a first cylindrical part with a large diameter which is joined by way of an annular shoulder with a cylindrical headpiece having a diameter smaller than said large diameter, said headpiece having said middle hole extending therethrough and being located above said first cylindrical part; wherein said pocket in said housing has an annular step therein which separates a first part of said pocket which receives said first cylindrical part of said holding part from a second part of said pocket which has a small diameter and receives said headpiece; wherein said step of said pocket has at least one air inlet hole extending therethrough and communicating with a location outside said pocket; wherein said annular shoulder of said holding part is spaced from said step of said pocket and has an air hole extending therethrough and communicating with the inside of the vessel; and wherein said elastic diaphragm is located in a space between said shoulder of said holding part and said step of said pocket, said diaphragm being molded on and integral with one of said shoulder of said holding part and said headpiece thereof so that said diaphragm is seated elastically against said step and covers said air inlet hole therein.

2. The atomizer as claimed in claim 1, wherein said diaphragm is annular and coaxially encircles a portion of said holding part.

3. The atomizer as claimed in claim 2, wherein said diaphragm is axially spaced from said shoulder and is provided on said headpiece.

4. The atomizer as claimed in claim 2, wherein said diaphragm includes a flange-like part resting against said step, a sleeve-like part joined up with said shoulder so as to be concentric to said headpiece, and a part which is curved in cross section and connects said flange-like and sleeve-like parts.

5. The atomizer as claimed in claim 4, wherein said sleeve-like part is located concentrically within and said flange-like part is located concentrically outside an imaginary cylindrical surface.

* * * * *